US006347863B1

(12) United States Patent
Yuen

(10) Patent No.: US 6,347,863 B1
(45) **Date of Patent: *Feb. 19, 2002**

(54) INK CAP

(76) Inventor: Kenneth Yuen, 1613 Chelsea Rd., San Marino, CA (US) 91108

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/701,864

(22) Filed: Aug. 23, 1996

(51) Int. Cl.[7] ..... B41J 2/175
(52) U.S. Cl. ..... 347/85
(58) Field of Search ..... 347/86, 85, 87; 436/180

(56) References Cited

U.S. PATENT DOCUMENTS 4,507,056 A * 3/1985 Allen ..... 417/54
5,270,219 A * 12/1993 DeCastro et al. ..... 436/180
5,315,317 A * 5/1994 Terasawa et al. ..... 347/7
5,546,830 A * 8/1996 Yuen ..... 81/3.39

FOREIGN PATENT DOCUMENTS

JP 5-96744 * 4/1993

* cited by examiner

*Primary Examiner*—N. Le
*Assistant Examiner*—Michael Nghiem
(74) *Attorney, Agent, or Firm*—Merchant & Gould P.C.

(57) ABSTRACT

Apparatus for refilling an ink cartridge includes an ink container constructed and arranged to be connectable to the bottom portion of a printer ink cartridge. The ink container has interior walls defining at least one internal ink tank. The internal walls include a bottom internal wall, a top internal wall and a end side internal wall. A drain conduit extends downwardly from the ink container. The drain conduit has an upper opening near the bottom internal wall of the ink tank and a lower opening located externally at the ink tank. A vent conduit extends downwardly from the ink container. The vent conduit also has an upper opening near the top internal wall of the ink tank and a lower opening located externally of the ink tank.

23 Claims, 2 Drawing Sheets

INK CAP

TECHNICAL FIELD

This invention relates to printers, and more particularly to ink cartridges for printers.

BACKGROUND ART

Ink jet printers are a popular form of printer used with computers and similar applications involving document printing or graphics preparation. Typical ink jet printers, such as those manufactured by Hewlett Packard, have replaceable ink jet cartridges with built-in printheads. While such OEM ink jet cartridges are a convenient manner of supplying ink to such printers, the cartridges are necessarily expensive due to their complexity and the provision of printheads with the cartridges. Cartridges provided by printer manufacturers are typically not designed to be refilled when the ink supply runs out. It is well known, however, that such cartridges have useful lives significantly longer than that provided by the initial supply of ink; therefore, a substantial effort has been directed to providing systems for refilling cartridges with ink. The need to provide ink refilling is especially acute in the case of color ink cartridges, because typically one color will run out of ink before the other colors are depleted.

Refilling ink cartridges with ink is not an easy task. First, some means must be provided to break open the cartridges, such as the ink cartridge opener described in my U.S. Pat. No. 5,546,830, the disclosure of which is herein incorporated by reference. Then, because the ink reservoirs are typically filled with foam, the ink refilling process is slow due to slow absorption of ink by the foam. Users typically do not have the patience to refill slowly, and this causes ink to overflow from the top and from the printhead. In addition, it is very common to accidentally inject air into the foam reservoir during refilling, causing air lock in the ink reservoir. Ink then cannot reach the printhead, and the printer fails.

One prior art solution is a "Clip-In" type refill system. The original ink cartridge is modified by removing all of the original ink reservoirs, such that only the printheads and the case are left. Removable ink reservoirs are supplied, so the user only has to change the ink reservoir assembly causing no mess. The disadvantage of this system is that it the user must be supplied with a pre-modified cartridge specially-adapted for use only with the removable ink reservoirs, and in practice, this system is nearly as costly as OEM printer cartridges.

Thus, there presently exists a need for a simple and inexpensive method of refilling printer ink cartridges that eliminates the problems of slow refilling and potential air lock problems.

SUMMARY OF THE DISCLOSURE

The present invention provides a replacement top portion for a printer ink cartridge that is useable with the original bottom portion of the OEM cartridge. The replacement top portion has internal walls defining at least one ink tank. Drain and vent conduits are adapted and arranged to slowly replenish the ink reservoir(s) in the bottom portion and to automatically maintain a level of ink in the reservoir until the replenishment ink in the top portion is depleted.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
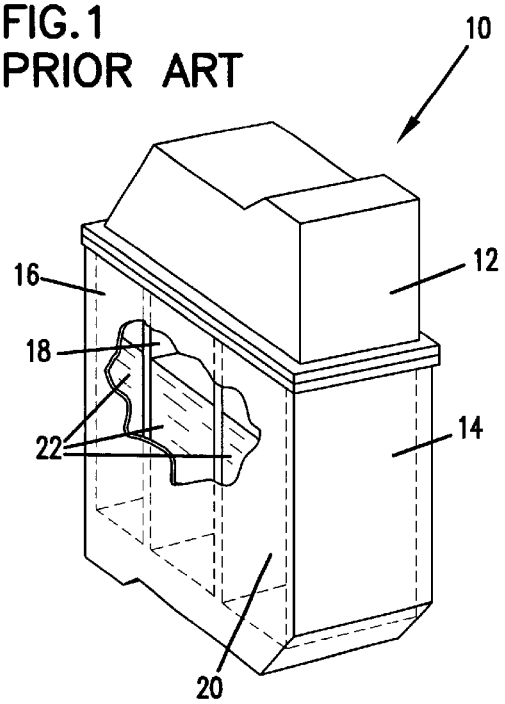
FIG.1 PRIOR ART
FIG. 1 is a perspective view of a prior art OEM printer ink cartridge.

Referring initially to FIG. 1, a prior art printer ink cartridge 10 has a top portion 12 and a bottom portion 14. Ink cartridge 10 has a plurality of internal ink reservoirs 16, 18, 20 typically filled with different colors of liquid ink 22. Ink cartridge can be broken open by separating top and bottom portions 12,14. One convenient way to do so is by using the ink cartridge opener described in my U.S. Pat. No. 5,546,830.

Figure 3:
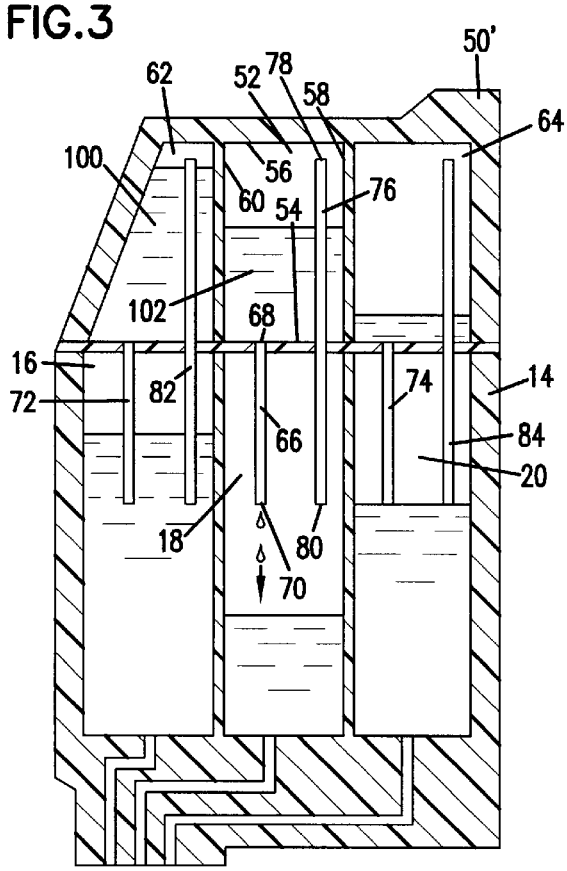
FIG. 3 is a schematic view of the ink container in operation.
Figure 2:
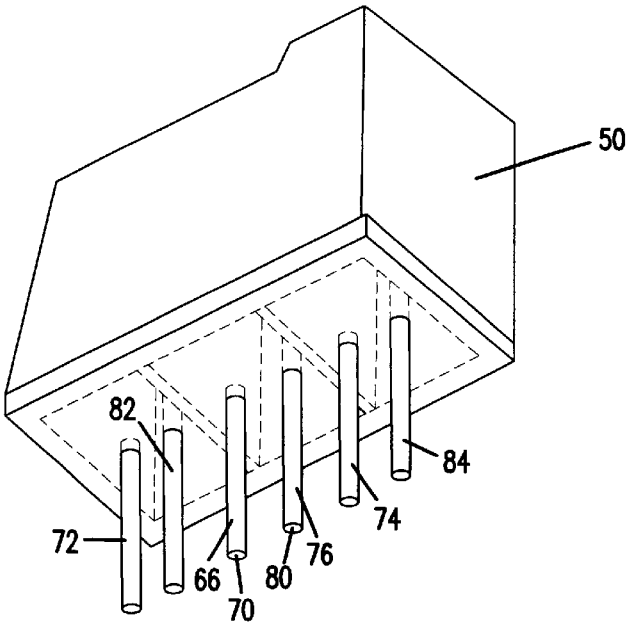
FIG. 2 is a perspective view of the ink container of the present invention.

Referring now to FIGS. 2 and 3, the present invention includes an ink container 50 constructed and arranged to be connectable to the bottom portion 14 of printer ink cartridge 10. Container 50 has interior walls defining at least one internal ink tank 52, the internal walls including a bottom internal wall 54, a top internal wall 56 and side internal walls 58, 60. In the embodiment shown in FIGS. 2 and 3, printer ink cartridge bottom portion 14 is a color ink cartridge having a plurality of ink reservoirs 16, 18, 20, and ink container 50 has a corresponding number of internal ink tanks 52, 62, 64. Typically the reservoirs 16,18,20 are completely filled with foam, but for clarity the foam is omitted from FIG. 3.

At least one drain conduit 66 extends downwardly from ink container 50. Drain conduit 66 has an upper opening 68 near the bottom internal wall 54 of ink tank 52, and a lower opening 70 located externally of ink tank 52. In color cartridge applications, ink tanks 62 and 64 have corresponding drain conduits 72, 74.

A vent conduit 76 extends downwardly from ink container 50, with an upper opening 78 near the top internal wall 56 of ink tank 52 and a lower opening 80 located externally of the ink tank. Ink tanks 62 and 64 have corresponding vent conduits 82, 84. As best shown in FIG. 2, all of the drain conduits 66, 72, 74 are the same length and are disposed at the same horizontal level when container 50 is attached to cartridge bottom portion 14. Similarly all of the vent conduits 76, 82, 84 are the same length and at the same level when ink container 50 is installed. The length of the vent conduits establishes the refill level, but the drain conduit can even be eliminated or shortened to as short as a hole in the bottom internal wall of ink container 50, as long as adequate sealing is provided.

In the preferred embodiment, ink container 50 is dimensioned substantially the same as top portion 12 of the pre-determined type of ink cartridge body shown in FIG. 1. Thus, ink container 50 is adapted to replace the top portion 12 with the drain and vent conduits extending downwardly into the ink cartridge bottom portion, as shown in FIG. 3, to replenish the ink cartridge bottom portion with ink.

Figure 4:
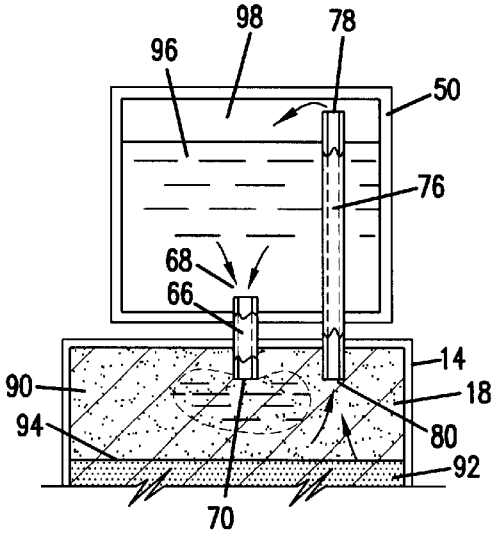
FIG. 4 is another schematic illustrating the principle of operation of the present invention.

The principle of operation is shown in FIG. 4. Ink reservoir 18 is typically filled with foam 90 which is slow to absorb ink. Ink 92 is at level 94, which is below the lower opening 80 of vent conduit 76. Ink 96 in tank 98 drains into foam 90 as shown by the arrows entering upper opening 68 and exiting lower opening 70 of drain conduit 66. As ink 96 drains into reservoir 18, a void is left behind in tank 98. The vacuum in tank 98 sucks air up vent conduit 76, as shown by the arrows entering lower opening 80 and exiting upper opening 78. The ink level in reservoir 18 continues to rise and eventually (if enough ink is present in tank 98) reaches and covers the lower opening 80 of vent conduit 76. When this happens, the air supply from reservoir 18 is cut off. Without further replacement for the void vacated by the ink exiting through drain conduit 66, the draining stops. So the position of the lower opening 80 of vent conduit 76 acts as a valve. As ink in reservoir 18 is consumed by the printhead, the lower opening 80 of vent conduit 76 is exposed to air again (inside the foam) and draining resumes.

As best shown in FIG. 3, there are three separate phases of operation. In reservoir 16, the original supply of ink is still sufficiently high that the lower opening of vent conduit 82 is covered. Ink 100 is at the original level supplied with ink container 50, ready to replenish reservoir 16 when needed. In contrast, ink 102 in ink reservoir 18 is below the lower opening 80 of vent conduit 76, so ink flows from ink container 50 into reservoir 18 as shown, according to the principles explained above in connection with FIG. 4. Finally, ink reservoir 20 illustrates the equilibrium state reached when the level of ink reaches the level of lower opening in vent conduit 84. As ink is used from reservoir 20, ink from tank 64 is slowly drained to maintain the equilibrium level shown.

Figure 5:
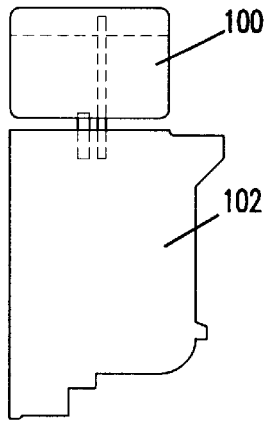
FIGS. 5, 6 and 7 are illustrations of alternate embodiments of the invention.
Figure 6:
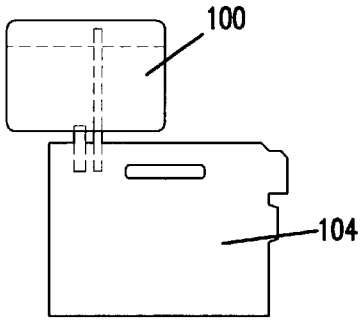
Figure 7:
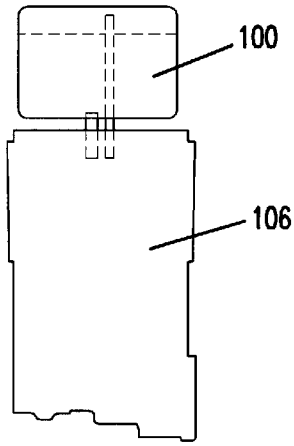

Alternate embodiments are shown in FIGS. 5, 6 and 7. While the embodiment shown in connection with FIGS. 2 and 3 may be recognized by those skilled in the art as useful with a popular Flewlett Packard ink jet printer cartridge, the invention can be used with printer cartridges supplied by many other manufacturers. In the embodiments shown in FIGS. 5, 6 and 7, a separate ink container 100 is supplied and connectable in piggy-back fashion to cartridges 102, 104, 106. Thus, alternatively the invention can be supplied in the form of an ink container 100 that is not dimensioned substantially the same as a removable top portion of an ink cartridge body. Container 100 is removed after the ink level in container is steady, indicating that the cartridge 102, 104 or 106 is full. FIGS. 5, 6 and 7 illustrate various alternative printer ink cartridges manufactured by, for example by, Canon.

In operation, the invention is based on the general principle that, in a closed system, the flow of a liquid out of a system must be balanced by an equal volume of fluid into the system. Thus, the ink container 50 consists of three basic elements, an enclosed ink tank filed with ink, a drain conduit, and a vent conduit. The open lower ends of the conduits are inserted into the lower bottom portion of a print cartridge. If the ink level in the cartridge is low, ink flows out of the drain conduit and seeps into the foam in the bottom portion reservoir, causing a vacuum in the ink container drawing air up through the vent conduit. When the ink level in the cartridge rises to the lower opening of the vent conduit, the ink seals the vent conduit. Air can no longer get into the ink container and thus shuts off the ink flow into the cartridge. Ink flow resumes as ink is being consumed by the cartridge. An equilibrium level is maintained until all of the ink in the ink container is used up.

The present invention is clean and "automatic" in that it operates on gravity. There is no need to squeeze ink into the foam, and thus the possibility of spilling is eliminated. The flow of ink is slow, so ink is completely absorbed by surrounding foam as the ink enters. In contrast, if ink is squeezed into the ink reservoir by hand, as in prior art systems, the flow is usually too fast to be absorbed, so ink accumulates at the bottom of the cartridge and leaks out through the printhead. There is also the possibility of trapping air and forming air pockets, thus cutting off ink flow to the printhead in the prior art systems. The refill level is controlled by the vent conduit. Filling stops when the pre-set level is reached. In conventional refilling, in contrast, the user does not know when the cartridge is full. Even when ink is overflowing, it still does not indicate if the cartridge is full or not, since overflowing could be due to the foam being unable to absorb ink quickly enough or due to air trapped underneath.

Whereas, the present invention has been described with respect to specific embodiments thereof, it will be understood that various changes and modifications will be suggested to one skilled in the art, and it is intended to encompass such changes and modifications as fall within the scope of the appended claims.

I claim:

1. An ink cartridge refilling system, comprising:

a printer ink cartridge having a print head;

an ink container configured as a close-fitting cap for the printer ink cartridge and connected as a cap to the printer ink cartridge;

the ink container having interior walls defining at least one internal ink tank, the internal walls including a bottom internal wall, a top internal wall, and side internal walls;

a drain conduit extending downwardly from the ink container, the drain conduit having an upper opening near the bottom internal wall of the ink tank and a lower opening located externally of the ink tank; and a vent conduit extending downwardly from the ink container, the vent conduit having a lower opening located externally of the ink tank.

2. The system of claim 1 wherein the printer ink cartridge includes a top portion and a bottom portion and wherein the ink container being connected to said bottom portion of the printer ink cartridge, with said top portion of the printer ink cartridge having been removed.

3. The system of claim 1 with the ink tank containing ink.

4. The system of claim 1 with a plurality of ink tanks, and each ink tank being fitted with drain and vent conduits.

5. The system of claim 2 wherein the printer ink cartridge includes a top portion and a bottom portion and wherein the ink container is dimensioned substantially the same as the top portion of the ink cartridge body, to replace said top portion, with the vent conduit extending downwardly into said ink cartridge bottom portion to replenish said ink cartridge bottom portion with ink.

6. An ink cartridge refilling system, comprising:

a printer ink cartridge having a print head, a top portion and a bottom portion;

an ink container configured as a close-fitting cap for the printer ink cartridge and connectable as a cap to the bottom portion of the printer ink cartridge upon the top portion of the printer ink cartridge being removed;

the ink container having interior walls defining at least one internal ink tank, the internal walls including a bottom internal wall, a top internal wall, and side internal walls;

a drain conduit extending downwardly from the ink container, the drain conduit having an upper opening near the bottom internal wall of the ink tank and a lower opening located externally of the ink tank;

a vent conduit extending downwardly from the ink container, the vent conduit having a lower opening located externally of the ink tank;

the ink tank containing ink; and with the ink container being dimensioned substantially the same as a top portion of a predetermined type of ink cartridge body, to replace the top portion, with the drain conduit and the vent conduit extending downwardly into the ink cartridge bottom portion to replenish the ink cartridge bottom portion with ink.

7. An ink cartridge refilling system, comprising:

a printer ink cartridge having a print head, a top portion and a bottom portion;

an ink container configured as a close-fitting cap for the printer ink cartridge and connectable as a cap to the bottom portion of the printer ink cartridge upon the top portion of the printer ink cartridge being removed;

the ink container having interior walls defining a plurality of internal ink tanks, the internal walls including a bottom internal wall, top internal wall, and side internal walls;

drain conduits extending downwardly from the ink container, the drain conduits having upper openings near the bottom internal walls of the ink tanks and lower openings located externally of the ink tank;

vent conduits extending downwardly from the ink container, the vent conduits having lower openings located externally of the ink tanks;

with the ink tanks containing ink; and with the ink container being dimensioned substantially the same as a top portion of the ink cartridge body, to replace the top portion, with the drain and vent conduits extending downwardly into the ink cartridge bottom portion to replenish the ink cartridge bottom portion with ink.

8. An ink cartridge refilling system, comprising:

a printer ink cartridge housing having a print head and a housing interior for containing ink to supply to the print head;

an ink container configured as a close-fitting cap for the printer ink cartridge housing and having at least one ink reservoir configured to be connected to the printer ink cartridge housing;

at least one ink communication path coupling the ink reservoir in ink flow communication with the printer ink cartridge housing interior, upon connecting the ink container to the printer ink cartridge housing; and at least one vent communication path coupling the ink reservoir in air flow communication with the printer ink cartridge housing interior, upon connecting the ink container to the printer ink cartridge housing.

9. A system as recited in claim 8, wherein said ink communication path comprises an elongated ink conduit extending from the ink reservoir, into the ink cartridge housing interior, upon connecting the ink container to the printer ink cartridge housing.

10. A system as recited in claim 8, wherein said ink communication path comprises an ink flow aperture connecting the ink reservoir with the ink cartridge housing interior, upon connecting the ink container to the printer ink cartridge housing.

11. A system as recited in claim 8, wherein the ink container is constructed and arranged to be connectable to the ink cartridge housing and to define a top of the ink cartridge housing.

12. A system as recited in claim 8, wherein each ink reservoir contains ink.

13. An ink cartridge refilling system, comprising:

a printer ink cartridge housing having a print head, a housing interior configured to contain at least one variable volume of ink defining a variable ink level within the housing and to supply such ink to the print head, said variable ink level being variable at least up to and including a first level in the housing;

an ink container configured as a close-fitting cap for the printer ink cartridge housing and connectable to the printer ink cartridge housing, the ink container having at least one ink reservoir for containing a volume of ink;

an ink communication path located to couple at least one ink reservoir in ink flow communication with the printer ink cartridge housing interior, upon connecting the ink container to the printer ink cartridge housing; and a vent conduit to couple the at least one ink reservoir in air flow communication with the printer ink cartridge housing interior, upon connecting the ink container to the printer ink cartridge housing;

the vent conduit extending from the ink reservoir, to the first level in the ink cartridge housing interior and conveys air to the ink reservoir upon the variable ink level within the ink cartridge housing interior being below the first level, upon connecting the ink container to the printer ink cartridge housing.

14. An ink cartridge refilling system, comprising:

a printer ink cartridge housing having a print head and a housing interior configured to contain at least one variable volume of ink defining a variable ink level within the housing and to supply such ink to the print head;

an ink container configured as a close-fitting cap for the printer ink cartridge housing and connectable as a cap to the printer ink cartridge housing, the ink container having at least one ink reservoir defining a reservoir interior for containing a variable volume of ink and a variable air pressure;

an ink communication path located to couple at least one ink reservoir interior in ink flow communication with the printer ink cartridge housing interior, for providing an flow pressure in the ink communication path, upon connecting the ink container to the printer ink cartridge housing; and a vent opening in the at least one ink reservoir, for air flow communication to the ink reservoir interior;

the ink container and ink cartridge housing, when connected, define a pressure distribution system in which ink flow through the ink communication path from the ink reservoir to the cartridge housing interior effects a decrease in air pressure within the ink reservoir, which causes air to be drawn into the ink reservoir through the vent opening.

15. A system as recited in claim 14, wherein said vent opening comprises a vent conduit extending from the ink reservoir, into the ink cartridge housing interior, upon connecting the ink container to the printer ink cartridge housing.

16. A system as recited in claim 15, wherein the ink cartridge housing defines a first level within the ink cartridge housing interior and wherein said vent conduit extends to the first level within the ink cartridge housing interior and conveys air to the ink reservoir upon the variable ink level within the ink cartridge housing interior being below the first level.

17. A system as recited in claim 14, wherein said ink communication path comprises an elongated ink conduit extending from the ink reservoir, into the ink cartridge housing interior, upon connecting the ink container to the printer ink cartridge housing.

18. A system as recited in claim 14, wherein the ink container is constructed and arranged to be connectable to the ink cartridge housing and to define a top of the ink cartridge housing.

19. A method of refilling a printer ink cartridge housing having a housing interior for containing ink to supply to a print head, the method comprising steps of:

coupling an ink container having at least one ink reservoir to a printer ink cartridge housing having at least one print head, the ink container forming a close-fitting cap to the printer ink cartridge housing upon being coupled thereto;

coupling at least one ink reservoir in ink flow communication with the printer ink cartridge housing interior, upon connecting the ink container to the printer ink cartridge housing; and coupling the ink reservoir in air flow communication with the printer ink cartridge housing interior, upon connecting the ink container to the printer ink cartridge housing.

20. A method as recited in claim 19, further comprising steps of:

conveying ink from each ink reservoir to the ink cartridge housing interior, to reduce the volume of ink and the air pressure within the ink reservoir;

conveying air pressure from the ink cartridge housing interior to the ink reservoir, to counteract at least part of the reduction in air pressure in the ink reservoir, upon conveying ink from the ink reservoir to the ink cartridge housing interior.

21. An ink refill device, comprising:

an ink container containing ink;

the ink container having walls defining at least one internal ink tank, the walls including a bottom wall having a top surface;

a drain conduit extending downwardly from the bottom wall of the ink container, the drain conduit having an upper opening located at the bottom wall of the ink tank so as not to project above the top surface of the bottom wall and a lower opening located externally of the ink tank, the drain conduit being permanently connected to the bottom wall of the ink container; and a vent conduit extending downwardly from the bottom wall of the ink container, the vent conduit having a lower opening located externally of the ink tank, and the vent conduit being permanently connected to the bottom wall of the ink container.

22. A ink refill device, comprising:

an ink container containing ink;

the ink container having walls defining at least one internal ink tank, the walls including a bottom wall having a top surface;

a drain conduit extending downwardly from the bottom wall of the ink container, the drain conduit having an upper end portion and a lower end portion, the upper end portion being positioned so as to not project above the top surface of the bottom wall, the lower end portion being located externally of the ink tank; and a vent conduit extending downwardly from the ink container, the vent conduit having a lower opening located externally of the ink tank.

23. An ink fill device, comprising:

an ink container containing ink;

the ink container having walls defining at least one internal ink tank, the walls including a bottom wall;

a drain conduit extending downwardly from the bottom wall of the ink container, the drain conduit having an upper opening located at the bottom wall of the ink tank and a lower opening located externally of the ink tank, the drain conduit being connected to the bottom wall of the ink in such a manner that the drain conduit is not free to move axially relative to the ink tank; and a vent conduit extending downwardly from the bottom wall of the ink container, the vent conduit having a lower opening locate externally of the ink tank, and the vent conduit being connected to the bottom wall of the ink tank in such a manner that the vent conduit is not free to move axially relative to the ink tank.

* * * * *